US009807522B2

(12) United States Patent
Pedersen et al.

(10) Patent No.: US 9,807,522 B2
(45) Date of Patent: Oct. 31, 2017

(54) HEARING DEVICE ADAPTED FOR ESTIMATING A CURRENT REAL EAR TO COUPLER DIFFERENCE

(71) Applicant: Oticon A/S, Smørum (DK)

(72) Inventors: Michael Syskind Pedersen, Smørum (DK); Steen Michael Munk, Smørum (DK); Jacob Lindvig, Smørum (DK)

(73) Assignee: OTICON A/S, Smorum (DK)

( * ) Notice: Subject to any disclaimer, the term of this patent is extended or adjusted under 35 U.S.C. 154(b) by 15 days.

(21) Appl. No.: 14/979,177

(22) Filed: Dec. 22, 2015

(65) Prior Publication Data

US 2016/0183012 A1 Jun. 23, 2016

(30) Foreign Application Priority Data

Dec. 23, 2014 (EP) ..... 14200263

(51) Int. Cl.
*H04R 25/00* (2006.01)

(52) U.S. Cl.
CPC ..... *H04R 25/505* (2013.01); *H04R 25/30* (2013.01); *H04R 25/48* (2013.01); *H04R 25/554* (2013.01);
(Continued)

(58) Field of Classification Search
CPC ..... H04R 25/30; H04R 25/48; H04R 25/70; H04R 25/505; H04R 25/554;
(Continued)

(56) References Cited

U.S. PATENT DOCUMENTS 8,280,086 B2 * 10/2012 Topholm ..... H04R 25/558 381/315
2006/0045282 A1 3/2006 Reber
(Continued)

FOREIGN PATENT DOCUMENTS

EP 1594344 A2 11/2005
EP 2613566 A1 7/2013
(Continued)

OTHER PUBLICATIONS

Munro, "Die Integration der RECD in den Hörgeräte-Anpassprozess", Focus 33, Oct. 13, 2004. pp. 1-23. URL:https://web.archive.org/web/20141013054200/http://www.phonak.com/content/dam/phonak/b2b/C_M_tools/Library/focus/de/028_0935_01_focus_33.pdf.

(Continued)

*Primary Examiner* — Brian Ensey
(74) *Attorney, Agent, or Firm* — Birch, Stewart, Kolasch & Birch, LLP

(57) ABSTRACT

The application relates to a hearing device comprising an ITE-part adapted for being located at or in an ear canal of a user, a configurable signal processing unit for processing an input signal, and a feedback estimation unit for providing a current estimate of an acoustic feedback path from an output transducer to an input transducer, a memory for storing frequency dependent reference estimates of the acoustic feedback path the real ear to coupler difference, when the ITE-part is correctly mounted, an optional probe signal generator for generating a probe signal at least in a specific measurement mode, wherein the hearing device is configured to perform measurement of the current estimate of the acoustic feedback path. The hearing device further comprises a control unit operatively connected to said memory and to said signal processing unit, and configured to compare said current estimate of the acoustic feedback path with (Continued)

said reference estimate of the acoustic feedback path, and to provide a current feedback path difference measure, and to determine a current estimate of real ear to coupler difference from the current feedback path difference measure. This has the advantage facilitating the mounting of the ear ITE-part. The invention may e.g. be used in hearing aids for compensating a user's hearing impairment.

17 Claims, 7 Drawing Sheets

(52) U.S. Cl.
CPC ..... *H04R 25/558* (2013.01); *H04R 25/70* (2013.01); *H04R 2225/025* (2013.01); *H04R 2225/51* (2013.01); *H04R 2430/01* (2013.01)

(58) Field of Classification Search
CPC ..... H04R 25/558; H04R 2225/025; H04R 2225/051; H04R 2430/01
USPC ..... 381/315
See application file for complete search history.

(56) References Cited

U.S. PATENT DOCUMENTS

| | | | | |
|---|---|---|---|---|
| 2006/0050911 | A1 | 3/2006 | Von Buol | |
| 2007/0217639 | A1* | 9/2007 | Stirnemann | H04R 25/70 381/321 |
| 2013/0294610 | A1 | 11/2013 | Munk | |
| 2015/0172839 | A1* | 6/2015 | Rung | H04R 25/30 381/60 |

FOREIGN PATENT DOCUMENTS

| | | | |
|---|---|---|---|
| EP | 2846559 | A1 | 3/2015 |
| WO | WO 2014/032726 | A1 | 3/2014 |

OTHER PUBLICATIONS

"Internet Archive Wayback Machine," https://web.archive.org/web/20130601000000*/http://www.phonak.com/content/dam/phonak/b2b/C_M_tools/Library/focus/de/028_0935_01_focus_33.pdf, retrieved on Jun. 17, 2015.

* cited by examiner

HEARING DEVICE ADAPTED FOR ESTIMATING A CURRENT REAL EAR TO COUPLER DIFFERENCE

TECHNICAL FIELD

The present application relates to hearing devices comprising a part (termed the ITE-part) adapted for being mounted at or in the ear of a user, in particular to ensuring that the ITE-part of the hearing device is correctly mounted and/or to automatically modify signal processing in dependence of a degree of misalignment of or leakage from the ITE-part.

The application furthermore relates to a method of operating a hearing device.

The application further relates to a data processing system comprising a processor and program code means for causing the processor to perform at least some of the steps of the method.

Embodiments of the disclosure may e.g. be useful in applications such as hearing aids for compensating a user's hearing impairment.

BACKGROUND

The following account of the prior art relates to one of the areas of application of the present application, hearing aids.

Real-ear-to-coupler difference (RECD) is defined as the difference in dB as a function of frequency between a sound pressure level (SPL) measured in the real-ear (of the particular user) and in a standard coupler (e.g. 2 $cm^3$, often written as 2-cc, or an IEC 711 coupler, etc.) acoustic coupler, as produced by a transducer generating the same input signal in both cases. When measuring the real-ear-to coupler difference the measured low frequency (LF) gain varies due to small variation in the ear-mould placement. The actual RECD may therefore vary every time the ear mould is inserted, making it difficult to provide the correct low frequency amplification.

US2007217639A1 deals with a real ear acoustic coupling quantity representative of the acoustic coupling of a hearing instrument to the user's ear or an anatomical transfer quantity is obtained from a transfer function representative of an acoustic transfer from the receiver to the outer microphone such as a signal feedback threshold gain. The obtained quantity may be used for setting a fitting parameter of the hearing instrument, for example a gain correction.

SUMMARY

By making a feedback measurement simultaneously with the RECD measurement, a reference measurement which can be used to adjust the amplification estimated by the RECD measurement, e.g. if the feedback path has increased compared to the reference feedback measurement next time the ear mould is mounted, we need to increase the LF gain compared to the gain estimated by the RECD measurement. Contrary, if the feedback path has decreased compared to the reference measurement, we need to decrease the low frequency amplification, because we have less leakage.

An object of the present application is to provide an improved hearing device.

Objects of the application are achieved by the invention described in the accompanying claims and as described in the following.

A Hearing Device:

In an aspect of the present application, an object of the application is achieved by a hearing device comprising

- a part, termed the ITE-part, adapted for being located at or in an ear canal of a user,
- an environment input transducer for converting an input sound signal to an electric input signal,
- an output transducer for converting an electric output signal to an output sound,
- a forward path comprising a configurable signal processing unit, which—at least in a specific normal mode of operation—is operationally coupled to the environment input transducer and to the output transducer, and adapted to process an input signal according to a set of processing parameters and to provide a processed output signal;
- a feedback estimation unit for providing a current estimate of an acoustic feedback path from the output transducer to the environment input transducer
- access to a memory for storing
  - a frequency dependent reference estimate of the acoustic feedback path from the output transducer to the environment input transducer, or a parameter derived therefrom, when the ITE-part is correctly mounted, and
  - a frequency dependent reference estimate of real ear to coupler difference, or a parameter derived therefrom, when the ITE-part is correctly mounted, and wherein the hearing device is configured—in a specific measurement mode—to perform a feedback measurement, and to provide a frequency dependent current estimate of the acoustic feedback path based on said probe signal, wherein the hearing device further comprises

- a control unit operatively connected to said memory, and configured to compare said current estimate of the acoustic feedback path based on said probe signal with said reference estimate of the acoustic feedback path, and to provide a current feedback path difference measure, and to determine a current estimate of real ear to coupler difference from current feedback path difference measure.

An advantage of making simultaneous reference measurements of the feedback path and the RECD is that the requirements to a careful mounting of the ear mould during normal use are reduced.

The term 'when the ITE-part is correctly mounted' is in the present context taken to mean that the ITE part is mounted as intended for its normal use, e.g. so that it is located in the ear canal to provide minimum leakage, as e.g. determined in a reference measurement (e.g. in a fitting session by a hearing care professional), e.g. prior to normal use of the hearing device. The term 'when the ITE-part is correctly mounted' is thus taken to imply that the ITE part is mounted so that a measured acoustic feedback path from the output transducer to the environment input transducer equals the frequency dependent reference estimate (as e.g. measured in advance of normal use, and stored in the memory of the hearing device or in a memory accessible to the hearing device).

The terms 'specific normal mode of operation' and 'specific measurement mode of operation' are in the present context both taken to mean modes of operation of the hearing device during its normal wear by a user, where the ITE-part of hearing device is located at or in an ear canal of the user.

Preferably, reliable reference RECD and feedback path measurements are at hand. Preferably the RECD and a feedback path measurements are made under substantially the same acoustic conditions.

Another advantage is that, an improved estimate of the reference RECD (than a 1 to 1 copy) on the opposite ear can be made based on a feedback path measurement on the opposite ear.

In an embodiment, the reference RECD value is solely based on simulation, e.g. based on age, which on both ears adjust based on a measured feedback paths.

In an embodiment, current RECD is measured during normal operation of the hearing device, e.g. using an input transducer (for picking up sound in the residual volume) located in the ITE-part and facing the ear drum, when the ITE-part is mounted in the ear canal of the user. The current RECD measurement may be used to fine tune prescribed gain values.

As an alternative to measuring the RECD, the gain may be fine tuned based on the current feedback path estimate as described in the present disclosure.

In an embodiment, the feedback path is estimated solely based on the input sound signal.

In an embodiment, the hearing device comprises a probe signal generator for generating a probe signal, the probe signal generator being operatively connected to the output transducer, at least in a specific measurement mode. In an embodiment, the hearing device comprises a probe signal generator for generating a probe signal, and—in the specific measurement mode—the hearing device is configured to perform a feedback measurement by the feedback estimation unit by feeding the probe signal to the output transducer and receiving a resulting feedback signal by the environment transducer. In other words, in the specific measurement mode, the hearing device is configured to provide a frequency dependent current estimate of the acoustic feedback path based on the probe signal. Thereby feedback path changes due to different earmold placements can be identified (substantially without any influence from acoustic changes in the surroundings).

In an embodiment, the memory is located in the hearing device. In an embodiment, the memory is located in another device in communication with the hearing device, e.g. another hearing device or an auxiliary device, e.g. a remote control device, e.g. a cellular telephone. In such case the hearing device and the 'other device' contain appropriate antenna and transceiver circuitry to allow the establishment of a (e.g. wireless) communication link between them, thereby allowing the hearing device to access the memory (e.g. to read reference values of the feedback estimate and RECD).

In an embodiment, the control unit is configured to determine updated processing parameters based on said current estimate of real ear to coupler difference. In an embodiment, such processing parameters comprise frequency dependent gains derived from real ear to coupler difference, e.g. using a fitting rationale. A fitting rationale (algorithm) is e.g. used by a hearing care professional (HCP, e.g. an audiologist) to determine a prescribed gain versus frequency for a particular hearing impairment and a particular person (ear/hearing aid). A fitting algorithm, such as NAL-RP, NAL-NL2 (National Acoustic Laboratories, Australia), DSL (National Centre for Audiology, Ontario, Canada), ASA (American Seniors Association), etc., is generally used for this purpose. Alternatively, other proprietary schemes can be used. Among the inputs to such fitting algorithms are a) data related to a user's hearing ability, such as hearing threshold or hearing loss data (e.g. based on an audiogram), and comfort level for the user in question, b) type of hearing aid, and c) real-ear-to-coupler difference (RECD) measure. In an embodiment, the hearing device comprises an algorithm for determining an appropriate prescribed gain from an estimated real-ear-to-coupler difference (RECD) or a table of corresponding values.

Preferably, the control unit is operatively connected to the signal processing unit (e.g. in a specific mode of operation, e.g. in the specific measurement mode). In an embodiment, the control unit is configured to transfer said updated processing parameters to said configurable signal processing unit for use instead of previous processing parameters. In other words, the processing of an input signal to the signal processing unit is modified by the updated (modified) processing parameters. In an embodiment, such update is only performed, if the changes are larger than a predefined first threshold. In an embodiment, an upper limit to the changes made during an update of the processing parameters.

In an embodiment, the feedback estimation unit is configured to estimate the current acoustic feedback path from the output transducer to the environment input transducer at a number $N_{FBP}$ of frequencies. In an embodiment, the frequency dependent reference estimate of the acoustic feedback path stored in the memory is provided at a number $N_{FBPref}$ of frequencies. In an embodiment, $N_{FBPref}$ is larger than or equal to $N_{FBP}$. In an embodiment, the frequency dependent reference estimate of real ear to coupler difference is provided at a number $N_{RECDref}$ of frequencies. In an embodiment, $N_{RECDref}$ is larger than or equal to $N_{FBP}$. In an embodiment, one of the or both stored reference values of the acoustic feedback path and of the real ear to coupler difference is/are determined at a fitting session. Alternatively, one or both parameters may be estimated (e.g. using average) values for a particular 'type' of user, e.g. male, female, child, or according to some other classification.

A change in RECD may e.g. be estimated by the following equation:

$$\Delta RECD(f) = u(f)\sum_{f'=0}^{f'_{max}} w(f, f')\Delta FBP(f')$$

where ΔRECD(f) is the estimated change in RECD for a given frequency f, ΔFBP is the difference between the reference feedback path and the estimated current feedback path (as measured), f' denotes frequencies belonging to a frequency interval within the range $[f'_{min}; f'_{max}]$, w(f,f') is a weighting function. I.e. we estimate a change in RECD by estimating a frequency weighted average change of the feedback path. The weighting function w may e.g. only weight frequencies in a selected frequency range, e.g. between 1000 Hz and 3000 Hz. The weighting function w may depend on frequency f. u(f) is another weighting function. Both u(f) and w(f,f) can be estimated using training data (prerecorded sets of RECD and feedback path measurements), e.g. utilizing machine learning techniques, e.g. neural networks, such as deep neural networks (DNN). The reference RECD is thus modified by adding ΔRECD to the reference RECD. The ΔRECD may as well be saturated in order not to exceed a certain range (i.e. a limit is imposed on the allowed effect of ΔRECD).

If ΔFBP is too high, e.g. higher than a predetermined value, it may indicate that the hearing aid is not placed in the ear at all. In that case, the reference RECD should not be changed. Furthermore, when compensating for a change in RECD, the possibly increased hearing aid amplification should only be applied, if the resulting gain does not exceed the feedback limit.

In an embodiment, the control unit is configured to determine a current estimate of real ear to coupler difference in a frequency range below a predetermined threshold frequency $f_{th}$ from the current feedback path difference measure above said threshold frequency $f_{th}$. In an embodiment, the threshold frequency is in the range from 1 kHz to 2 kHz, e.g. around 1.5 kHz. In an embodiment, the control unit is configured to determine a current estimate of real ear to coupler difference in a first frequency range from the current feedback path difference measure in a second frequency range. In an embodiment, the first and second frequency ranges have no overlap. In an embodiment, the frequencies of the first frequency range are lower than the frequencies of the second frequency range.

Preferably, the control unit is operatively connected to the probe signal generator and/or to the feedback estimation unit (e.g. in a specific mode of operation, e.g. in the specific measurement mode). In an embodiment, the control unit is configured to bring the hearing device in said specific measurement mode and to initiate a feedback measurement by the feedback estimation unit according to a predefined scheme. In an embodiment, the predefined scheme comprises that the specific measurement mode is entered in connection with a power-up of the hearing device. The current feedback path can be estimated in the measurement mode as long as the probe signal is activated.

In an embodiment, the hearing device comprises a user interface allowing to transfer information to a user and/or a user to interact with the hearing device. In an embodiment, the user interface comprises an activation element allowing a user gain information of a current mode of operation and/or receive indications of results of a feedback measurement. In an embodiment, the user interface comprises an activation element allowing a user to influence functionality of the hearing device, e.g. to change a mode of operation, e.g. to initiate a feedback measurement by the feedback estimation unit and/or whether a modification of processing parameters is proposed or have been made. In an embodiment, the user interface is implemented in another device, e.g. a remote control or a cellular telephone, e.g. a SmartPhone.

In an embodiment, the hearing device is configured to indicate via said user interface whether the ITE part is correctly mounted. In an embodiment, an algorithm or table is stored in the memory of the hearing device, from which corresponding values of said current feedback path difference measure and an estimate of the current degree of mis-alignment of the ITE-part can be derived. In an embodiment, the control unit is configured to derive such current degree of mis-alignment of the ITE-part, and to present corresponding information via the user interface, e.g. including a suggestion to re-mount the ITE part and to subsequently initiate a renewed feedback measurement by the feedback estimation unit. In an embodiment, the ITE-part comprises an ear-mould. In an embodiment, the ITE-part comprises an open fitting, e.g. a dome-like structure.

In an embodiment, the ITE-part comprises said environment input transducer. In an embodiment, the hearing device comprises a BTE-part adapted for being located behind an ear of a user, wherein the BTE-part and the ITE-part are adapted to be in communication with each other (e.g. one or more of acoustic, electric, and optic). In an embodiment the ITE-part comprises an input transducer, termed the residual volume input transducer, adapted for being located to pick up sound in a residual volume between the ITE-part and the user's ear drum, when the ITE-part is mounted at or in an ear canal of a user. In an embodiment, the hearing device is configured to estimate a value of current RECD using the residual volume input transducer.

In an embodiment, the probe signal comprises a number of tones, e.g. pure or substantially pure tones. In an embodiment, the probe signal is a combination of different pure tones played at the same time (and possibly repeated with a predefined time interval), e.g. as a small melody or jingle. In an embodiment, the probe signal comprises a pure tone stepped sweep, and wherein for each pure tone frequency, the magnitude of a frequency domain signal representing the feedback path estimate at that frequency is determined. In the present context, the term 'a pure tone stepped sweep' is taken to mean that a number ($N_{pt}$) of pure tones are successively played at different points in time (e.g. with a predefined time interval) and for each pure tone frequency, the magnitude of a frequency domain signal representing the feedback path estimate at that frequency is determined. In an embodiment, the probe signal comprises a broad band signal. In the present context, the term 'a broad band signal' is taken to mean that the signal comprises a range of frequencies $\Delta f$ from a minimum frequency $f_{min}$ to a maximum frequency $f_{max}$ (presented simultaneously or sequentially). Preferably, $\Delta f$ constitutes a substantial part of the frequency range considered by the hearing device, e.g. at least an octave, or at least 25% of the active bandwidth of the hearing device, e.g. the range between 1 kHz and 2 kHz, e.g. the full frequency range considered by the hearing device (e.g. up to 6 kHz or 8 kHz or more). Alternatively or additionally, the probe signal may comprise one or more of a sine sweep, uncorrelated noise (such as white noise or pink noise), and a speech signal (the latter, if the device has a built in speech syntheses unit).

In an embodiment, the hearing device (e.g. the signal processing unit) is adapted to provide a frequency dependent gain to compensate for a hearing loss of a user.

In general, the present disclosure relates to hearing devices, where sound is presented in a small cavity in front of the eardrum. In an embodiment, the output transducer comprises a receiver (speaker) for providing an acoustic signal to the user. In an embodiment, the output transducer is located in the ear canal. In an embodiment, the output transducer is located in a BTE-part, e.g. behind an ear, and sound from the output transducer is conducted by a sound conducting element (e.g. a tube) to the ear canal (e.g. via an ear mould (e.g. the ITE part) located in or at the ear canal).

In an embodiment, the input transducer comprises a microphone. In an embodiment, the hearing device comprises a number of input transducers, e.g. a directional microphone system.

In an embodiment, the hearing device comprises an antenna and transceiver circuitry for wirelessly receiving a direct electric input signal from another device, e.g. a communication device or another hearing device.

In an embodiment, the hearing device has a maximum outer dimension of the order of 0.15 m (e.g. a handheld mobile telephone). In an embodiment, the hearing device has a maximum outer dimension of the order of 0.08 m (e.g. a head set). In an embodiment, the hearing device has a maximum outer dimension of the order of 0.04 m (e.g. a hearing instrument).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain.

In an embodiment, the hearing device comprises a level detector (LD) for determining the level of an input signal (e.g. on a band level and/or of the full (wide band) signal).

In an embodiment, the hearing device comprises an acoustic (and/or mechanical) feedback suppression system comprising a feedback estimation unit. In an embodiment, the feedback estimation unit comprises an adaptive algorithm for tracking feedback path changes over time. In an embodiment, the feedback estimation unit comprises a linear time invariant filter for which the filter weights are updated over time. The filter update may be calculated using stochastic gradient algorithms, including some form of Least Mean Square (LMS) or the Normalized LMS (NLMS) algorithms. They both have the property to minimize the error signal in the mean square sense with the NLMS additionally normalizing the filter update with respect to the squared Euclidean norm of some reference signal. Various aspects of adaptive filters are e.g. described in [Haykin].

In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof. In an embodiment, the hearing device comprises a hearing aid for compensating a user's hearing impairment.

Use:

In an aspect, use of a hearing device as described above, in the 'detailed description of embodiments' and in the claims, is moreover provided.

A Method of Operating a Hearing Device:

In an aspect, a method of operating a hearing device is provided. The hearing device comprises

- a part, termed the ITE-part, adapted for being located at or in an ear canal of a user,
- an environment input transducer for converting an input sound signal to an electric input signal,
- an output transducer for converting an electric output signal to an output sound,
- a forward path comprising a configurable signal processing unit, which—at least in a specific normal mode of operation—is operationally coupled to the environment input transducer and to the output transducer, and adapted to process an input signal according to a set of processing parameters and to provide a processed output signal;
- a feedback estimation unit for providing a current estimate of an acoustic feedback path from the output transducer to the environment input transduce.

The method comprises

- storing a frequency dependent reference estimate of the acoustic feedback path from the output transducer to the environment input transducer, or a parameter derived therefrom, when the ITE-part is correctly mounted,
- storing a frequency dependent reference estimate of real ear to coupler difference, or a parameter derived therefrom, when the ITE-part is correctly mounted,
- in a specific measurement mode initiating a feedback measurement by the feedback estimation unit based on a signal received by said environment transducer;
- providing a frequency dependent current estimate of the acoustic feedback path;
- comparing said current estimate of the acoustic feedback path with said reference estimate of the acoustic feedback path and providing a current feedback path difference measure;
- determining a current estimate of real ear to coupler difference from current feedback path difference measure.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

It is intended that the steps of the method are carried out in the hearing device. The reference estimates of the acoustic feedback path and real ear to coupler difference are e.g. measured by a hearing care professional (e.g. on a particular user of the hearing device) prior to ordinary use of the hearing device, e.g. during a fitting session, or average estimates, or the like. The storage of the reference estimates in the hearing device are preferably performed prior to ordinary use of the hearing device by a user.

In an embodiment, the method according comprises

- in the specific measurement mode, generating a probe signal,
- performing a feedback measurement by the feedback estimation unit by feeding the probe signal to the output transducer and receiving a resulting feedback signal by the environment transducer providing a frequency dependent current estimate of the acoustic feedback path based on the probe signal.

In an embodiment, the method according comprises determining updated processing parameters based on said current estimate of real ear to coupler difference; and transferring said updated processing parameters to said configurable signal processing unit for use instead of previous processing parameters.

In an embodiment, the method according comprises bringing the hearing device in said specific measurement mode and to initiate a feedback measurement by the feedback estimation unit according to a predefined scheme.

In an embodiment, the method according comprises providing that the predefined scheme comprises that the specific measurement mode is entered in connection with a power-up of the hearing device.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided. The hearing device and the auxiliary device preferably comprises antenna and transceiver circuitry for establishing a communication link between them and allowing an exchange of data between them. In an embodiment, the system is adapted to establish a communication link between the hearing device and the auxiliary device to provide that information (e.g. control and status signals, possibly audio signals) can be exchanged or forwarded from one to the other. In an embodiment, the data which can be exchanged comprise information related to current feedback measurements and/or current RECD. In an embodiment, the data which can be exchanged include audio data.

In an embodiment, the auxiliary device is or comprises an audio gateway device adapted for receiving a multitude of audio signals and for forwarding one of the received audio signals (or combination of signals) to the hearing device. In an embodiment, the auxiliary device is or comprises a remote control for controlling functionality and operation of the hearing device(s). In an embodiment, the auxiliary device comprises a cellphone, e.g. a SmartPhone. In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, hearing system comprises another hearing device. In an embodiment, the hearing system comprises two hearing devices adapted to implement a binaural hearing system, e.g. a binaural hearing aid system.

DEFINITIONS

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing devices, an amplifier may constitute the signal processing circuit. In some hearing devices, the output means may comprise an output transducer, such as e.g. a loudspeaker for providing an air-borne acoustic signal.

A 'hearing system' refers to a system comprising one or two hearing devices, and a 'binaural hearing system' refers to a system comprising one or two hearing devices and being adapted to cooperatively provide audible signals to both of the user's ears. Hearing systems or binaural hearing systems may further comprise 'auxiliary devices', which communicate with the hearing devices and affect and/or benefit from the function of the hearing devices. Auxiliary devices may be e.g. remote controls, audio gateway devices, mobile phones, public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Figure 1:
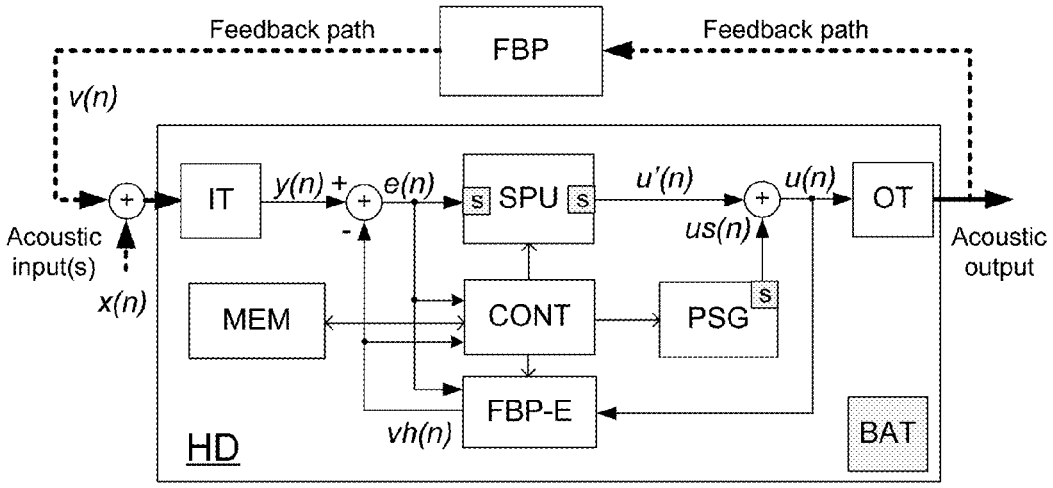
FIG. 1 shows an embodiment of a hearing device according to the present disclosure.

FIG. 1 shows an embodiment of a hearing device according to the present disclosure. The hearing device (HD) comprises an ITE-part adapted for being located at or in an ear canal of a user. The hearing device may further comprise additional parts in communication with the ITE-part, e.g. a BTE-part adapted for being mounted behind an ear of the user (cf. e.g. BTE in FIG. 2). Alternatively, the hearing device may be constituted by the ITE-part. The hearing device (HD) further comprises an environment input transducer (IT) for converting an input sound signal (Acoustic input(s) in FIG. 1) to an electric input signal y(n), an output transducer (OT) for converting an electric output signal u(n) to an output sound (Acoustic output in FIG. 1). A forward path is defined between the environment input transducer (IT) and the output transducer (OT), the forward path comprising a configurable signal processing unit (SPU), which—at least in a specific normal mode of operation—is operationally coupled to the environment input transducer (IT) and to the output transducer (OT). The configurable signal processing unit (SPU) is adapted to process an input signal according to a set of processing parameters (e.g. to compensate for the user's hearing impairment) and to provide a processed output signal u'(n). The hearing device (HD) further comprises a feedback estimation unit (FBP-E) for providing a current estimate of an acoustic feedback path (Feedback path in FIG. 1) from the output transducer (OT) to the environment input transducer (IT), as illustrated in FIG. 1 by the dashed line and box FBP indicating the feedback transfer function, resulting in feedback sound v(n) at the environment input transducer (IT). The hearing device (HD) further comprises a memory unit (MEM) wherein A) a frequency dependent reference estimate (Ref-FBP) of the acoustic feedback path from the output transducer to the environment input transducer, or a parameter derived therefrom, when the ITE-part is correctly mounted, and B) a frequency dependent reference estimate (Ref-RECD) of the real ear to coupler difference, or a parameter derived therefrom, when the ITE-part is correctly mounted, are stored. The hearing device (HD) may further comprise a probe signal generator (PSG) for generating a probe signal us(n), the probe signal generator being operatively connected to the output transducer, at least in a specific measurement mode (via switch s and combination unit '+'). The hearing device is—at least in the specific measurement mode—configured to perform a feedback measurement by the feedback estimation unit (FBP-E) by feeding the probe signal us(n) to the output transducer (OT) and receiving a resulting feedback signal y(n) by said environment transducer (IT), and to provide a frequency dependent current estimate of the acoustic feedback path based on said probe signal us(n). The measurement of the current feedback path is preferably performed in an open loop configuration, where the forward path is open, e.g. as illustrated in FIG. 1 by opening switches s the input and output of the signal processing unit (SPU). The hearing device (HD) further comprises a control unit (CONT) operatively connected to the memory unit (MEM), and configured to compare a current estimate of the acoustic feedback path vh(n) based on said probe signal with said reference estimate (Ref-FBP) of the acoustic feedback path stored in the memory unit (MEM), and to provide a current feedback path difference measure FBPM (e.g. representing a difference between (e.g. logarithmic representations of) the reference and the current feedback path estimate at a number of frequencies), and to determine a current estimate of real ear to coupler difference from the current feedback path difference measure. Instead of being based on a probe signal from a probe signal generator, the reference estimate of the feedback path (Ref-FBP) may be based on a signal picked up by the input transducer (either a specific acoustic probe signal played with the purpose of feedback estimation, or an input sound from the environment). In that case, the probe signal generator can be dispensed with.

The processing performed in the hearing device is preferably conducted in the digital domain, in which case appropriate analogue to digital and digital to analogue converters are included as is common in the art. The processing in the hearing device may be performed in the time domain (as e.g. indicated in the embodiment of FIG. 1, where n is a time index and u(n) represents a value of signal u at a (discrete) time n. Alternatively, some or all of the processing may be performed in the frequency domain, in which case appropriate time to time-frequency and time-frequency to time converters are included as is common in the art.

In the specific probe signal (or measurement) mode, the input sound signal x(n) (in addition to the acoustic feedback signal v(n)) is considered as noise, and should preferably be minimized (to improve convergence rates of the adaptive algorithm and/or the accuracy of the estimate).

The feedback estimation unit (FBP-E) and the SUM-unit ('+') in the forward path of the hearing device between the input transducer (IT) and the signal processing unit (SPU) form part of a feedback cancellation system for reducing or eliminating feedback occurring in the device during a normal mode of operation (where switches s at the input and output of the signal processing unit (SPU) are closed to allow input signals to be processed and forwarded to the output transducer (OT), here via combination unit (here SUM unit '+').

Likewise, the probe signal generator (PSG) may (in addition to the specific measurement mode) be used in a normal mode of operation of the hearing device, e.g. (as shown) so that a probe signal us(n) (e.g. activated via switch s) is added to the processed output signal u'(n) from the signal processing unit (SPU) to provide a combined output signal u(n) (=u'(n) us(n)), which is forwarded to the output transducer (OT) and to the feedback path estimation unit (FBP-E). The probe signal us(n) used in the normal mode may be different from the probe signal us(n) used in the specific measurement mode, in other words the probe signal generator (PSG) is preferably configurable (e.g. controlled by the control unit (CONT)).

Figure 5A:
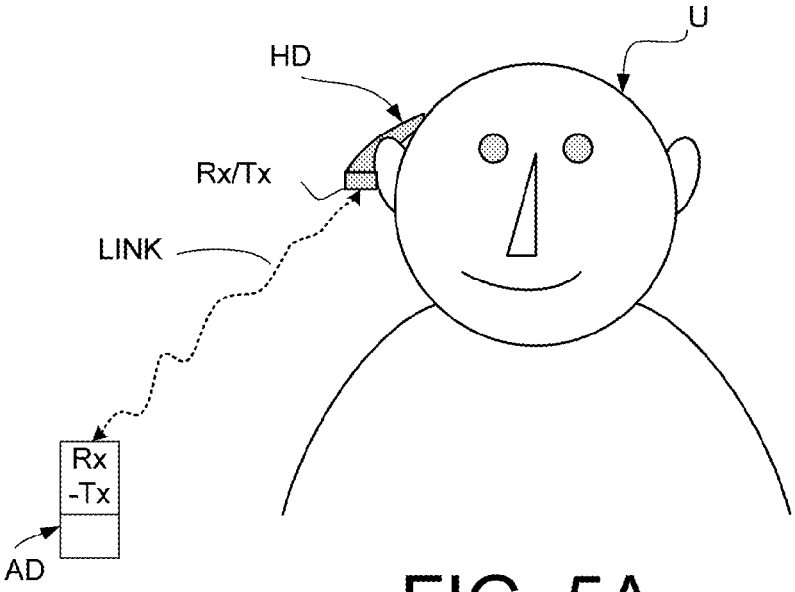
FIGS. 5A-5B show a hearing system according to an embodiment of the present disclosure, FIG. 5A showing a user wearer a hearing device in communication with an auxiliary device, FIG. 5B showing the auxiliary device running an APP for controlling the hearing device, including the initiation of an RECD estimation, FIGS. 6A-6B schematically show configurations of the hearing assistance device during an exemplary determination of a (reference) real ear to coupler difference, FIG. 6A showing the coupler measurement, and FIG. 6B showing the real ear measurement.
Figure 5B:
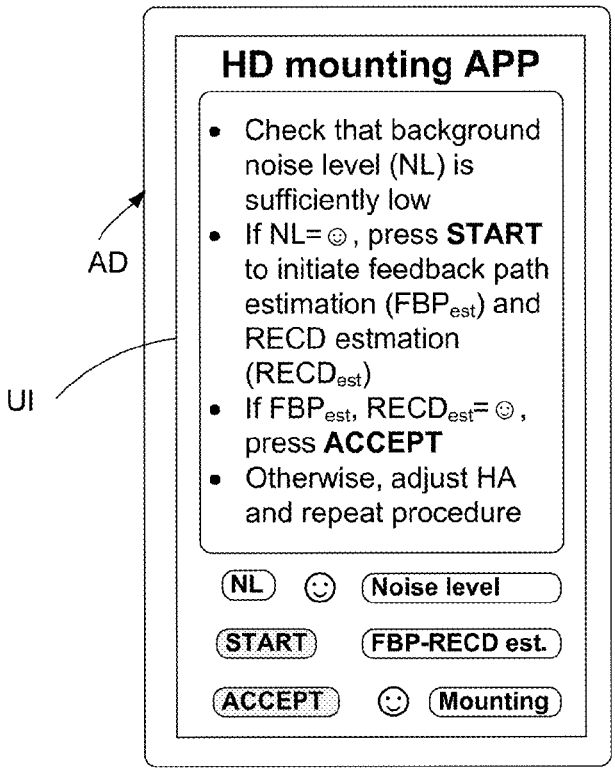

The states of the switches (influencing the mode of operation) are controlled via control unit (CONT) and/or via a user interface, e.g. implemented in an external (auxiliary) device, e.g. a remote control device or a programming device or a cellular telephone (e.g. a SmartPhone, cf. e.g. FIGS. 5A-5B).

The hearing device (HD) further comprises a battery (BAT, e.g. a rechargeable battery) for energizing the hearing device.

The control unit (CONT) is further configured to influence the feedback estimation unit (FBP-E), e.g. to decide a convergence time, e.g. an adaptation rate (e.g. a step size) of an adaptive algorithm (including to decide when the feedback estimate is valid and ready to be used to estimate a current RECD-value).

The feedback path estimation unit (FBP-E) may e.g. comprise an adaptive filter controlled by a prediction error algorithm, e.g. an LMS (Least Means Squared) algorithm, in order to predict and cancel the part of the microphone signal that is caused by feedback from the output transducer (OT) of the hearing device. The prediction error algorithm uses a reference signal (e.g. the output signal u(n)) together with a signal originating from the microphone signal (e.g. feedback corrected signal e(n)) to find the setting of the adaptive filter that minimizes the prediction error when the reference signal is applied to the adaptive filter. In a normal mode of operation, the estimate of the feedback path vh(n) provided by the feedback estimation unit (FBP-E) is subtracted from the microphone signal y(n) in sum unit '+' providing a so-called 'error signal' (or feedback-corrected signal e(n)), which is fed to the signal processing unit (SPU) and to the (algorithm part of the) the feedback estimation unit (FBP-E). To provide an improved decorrelation between the output and input signal, it may be desirable to add the probe signal us(n) to the output signal. This probe signal can be used as the reference signal to the algorithm part of the adaptive filter, and/or it may be mixed with the ordinary output u'(n) of the signal processing unit (SPU) to form the reference signal u(n).

Preferably, the control unit (CONT) is configured to determine updated processing parameters of the signal processing unit based on the current estimate of real ear to coupler difference. This can be done in various ways known in the art, e.g. using a fitting rationale (such algorithm or data being preferably stored in a memory of the hearing device, e.g. in the memory unit MEM). In an embodiment, the control unit (CONT) is configured to transfer such updated processing parameters to the configurable signal processing unit (SPU) for use instead of previous processing parameters. Thereby the signal processing is adapted to a current mounting situation of the hearing device, in particular of the ITE-part of the hearing device may be compensated for by modified processing parameters (e.g. prescribed gain). Hence the consequence to a user of a (possibly temporary or alternatively more permanent leakage) mismatch of the ITE-part to the ear canal of the user can be reduced. Such temporary or more permanent leakage may e.g. be due to mis-alignment of the ITE-part in the ear canal of the user or due to growth of the ear canal (e.g. of a child), respectively.

Figure 2:
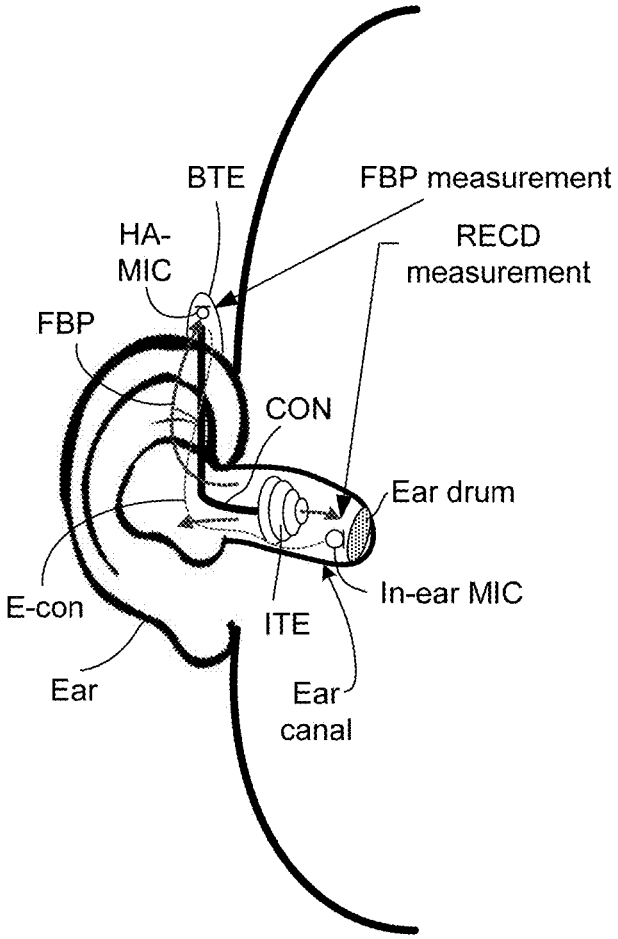
FIG. 2 illustrates the insertion of an ear-mould and a subsequent feedback measurement to predict the uncertainty of a simultaneous RECD measurement, FIGS. 3A-3B schematically show differences between exemplary feedback path and RECD measurements in case the ITE-part is correctly mounted/fits the ear canal of the user (FIG. 3A) and in case the ITE-part is not correctly mounted/does not fit the ear canal of the user.

FIG. 2 schematically illustrates the insertion of an ITE-part (ITE), e.g. an ear-mould, in an ear canal (Ear canal) of a user and a subsequent feedback measurement to predict the uncertainty of a simultaneous RECD measurement. FIG. 2 shows an embodiment of a hearing device (HD) according to the present disclosure comprising an ITE-part (ITE) adapted for being located at or in an ear canal (Ear canal) of a user and a BTE-part (BTE) adapted for being mounted behind an ear (Ear) of the user in communication with the ITE-part. In the embodiment of FIG. 2, the ITE-part and the BTE-part are connected by connecting element (CON). The ITE-part may comprise the output transducer (OT in FIG. 1), e.g. a loudspeaker (in which case the connecting element (CON) comprises appropriate electrical conductors. Alternatively, the output transducer, e.g. a loudspeaker, may be located in the BTE-part (in which case the connecting element (CON) comprises an acoustic conductor, e.g. a tubing element). An ear canal microphone (In-ear MIC) is located in the residual volume between the ITE-part and the ear drum (Ear drum). The ear canal microphone is configured to pick up sound in the residual volume and may be used to provide a real ear measurement of sound pressure level (SPL) (and thus contribute to an estimate of a current RECD-value). The ear canal microphone is electrically connected to a processor for determining RECD (RECD measurement), e.g. in the BTE-part, via electrical conductors (E-con). The ear canal microphone may form part of the ITE-part (see e.g. FIG. 4A) or may alternatively be a separate microphone (as indicated in FIG. 2). The BTE-part comprises an environment microphone (HA-MIC) for picking up sound from the environment of the hearing device, including any feedback from the output transducer (including the contribution leaked from the ear canal, as indicated by dotted arrow denoted FBP in FIG. 2). The environment microphone may e.g. be used (together with the electric output fed to the output transducer) in the estimation of the feedback path (FBP measurement).

Figure 3A:
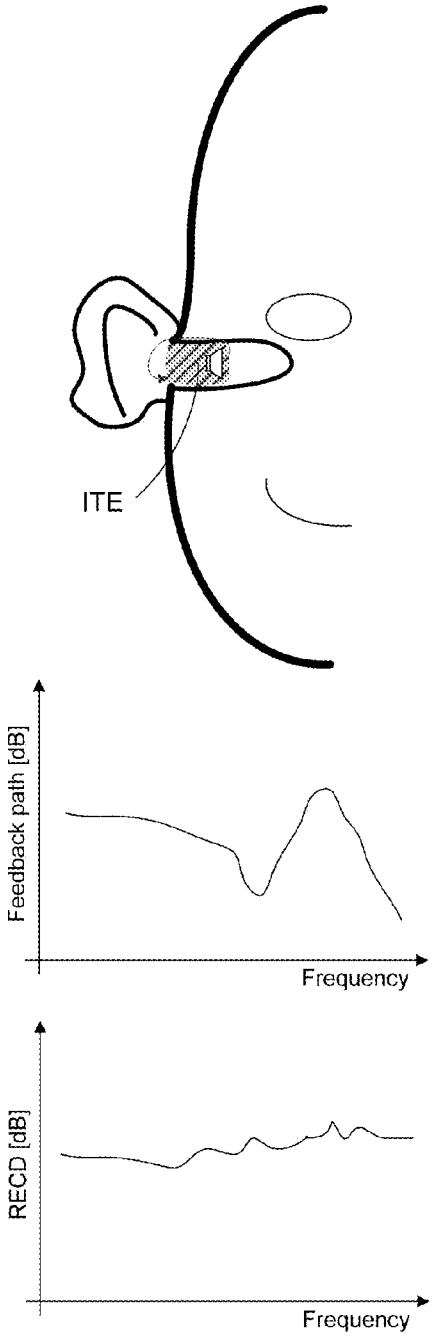
Figure 3B:
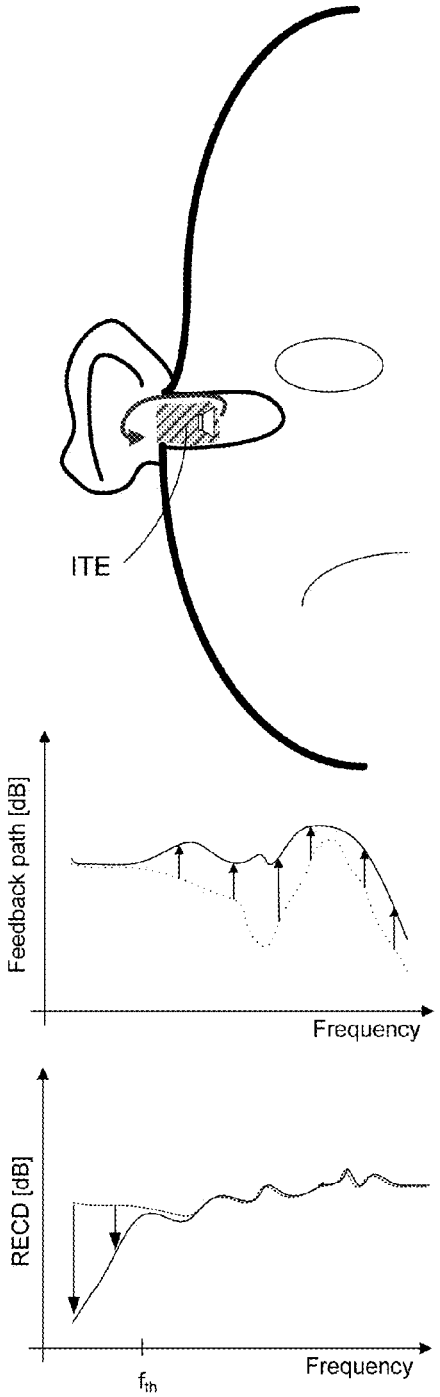

FIGS. 3A-3B schematically illustrate differences between exemplary feedback path and RECD measurements in case the ITE-part is correctly mounted/fits the ear canal of the user (FIG. 3A) and in case the ITE-part is not correctly mounted/does not fit the ear canal of the user. The top part of FIGS. 3A and 3B illustrate the mounting of the ITE-part (ITE) in the ear canal of the user. The arrow from the residual volume between the ITE-part and the ear drum to the environment outside the ear canal (and the location of an environment input transducer) illustrates a degree of feedback (leakage), a thin line (FIG. 3A) indicating a relatively small leakage indicating a good fit, and a thick line (FIG. 3B) indicating a relatively large leakage indicating a bad fit, respectively, of the ITE-part to the ear canal. The (solid line) graphs in the middle and bottom drawings schematically show frequency dependent values of the feedback path (middle) and RECD (bottom) for a relatively good fit (FIG. 3A) and a relatively bad fit (FIG. 3B), respectively. The graphs in FIG. 3B include (in dotted line) values from FIG. 3A for the relatively good fit, allowing a comparison of the parameter values for the two situations.

In the sketches of FIGS. 3A and 3B, the graphs are indicated as continuous lines. In practice, however, the measurements are typically performed at a number of discrete frequencies. In an embodiment, pure tones played at a limited number of frequencies and measurements of FBP and RECD at each frequency are performed. An estimation of the feedback path when the hearing device is remounted may be performed at fewer frequencies than used to estimate the reference feedback path (or the RECD measurement).

The present inventors have realized (as schematically indicated in FIG. 3B) that a feedback path measurement at a low frequency does not necessarily say anything about the amplification loss due to leakage. Instead it is proposed to use the feedback path measured at frequencies above a threshold frequency, $f_{th}$, e.g. 1500 Hz, to predict leakage below the threshold frequency $f_{th}$ (the frequency ranges may however overlap).

According to the present disclosure, the hearing device is hence configured to collect simultaneous RECD and feedback path measurements to improve the estimate of RECD based on the feedback measurement. The relationship between current feedback path and RECD is further described in connection with FIGS. 7A-7B.

Figure 4A:
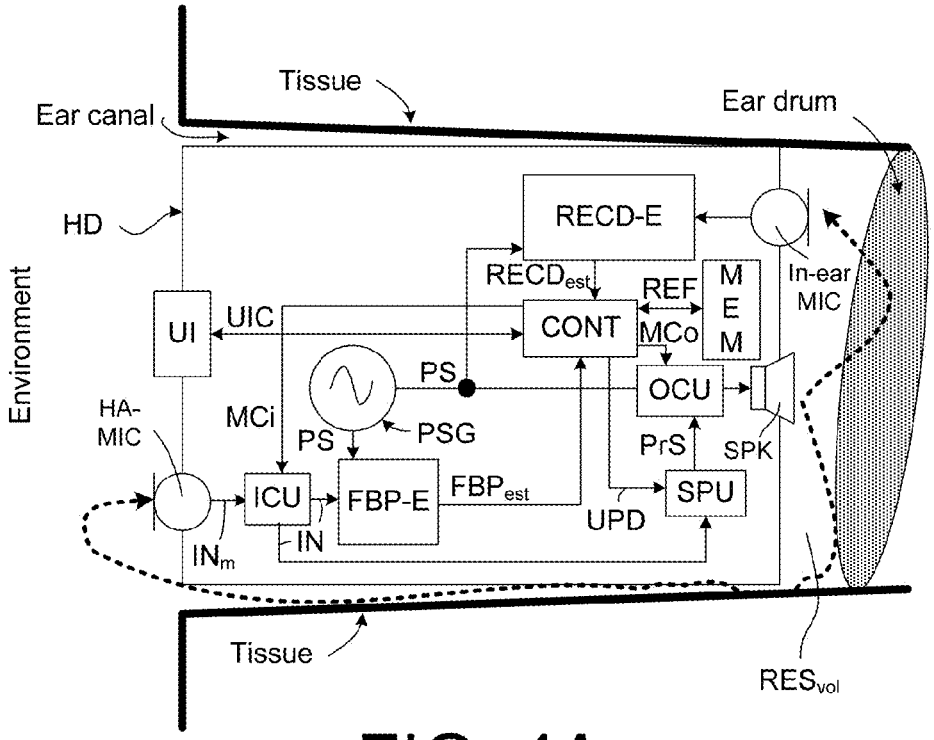
FIGS. 4A-4B show two embodiments of a hearing device according to the present disclosure, FIG. 4A illustrating an embodiment comprising an in-ear microphone for making a real ear measurement, FIG. 4B illustrating an embodiment configured to estimate RECD from a feedback measurement.
Figure 4B:
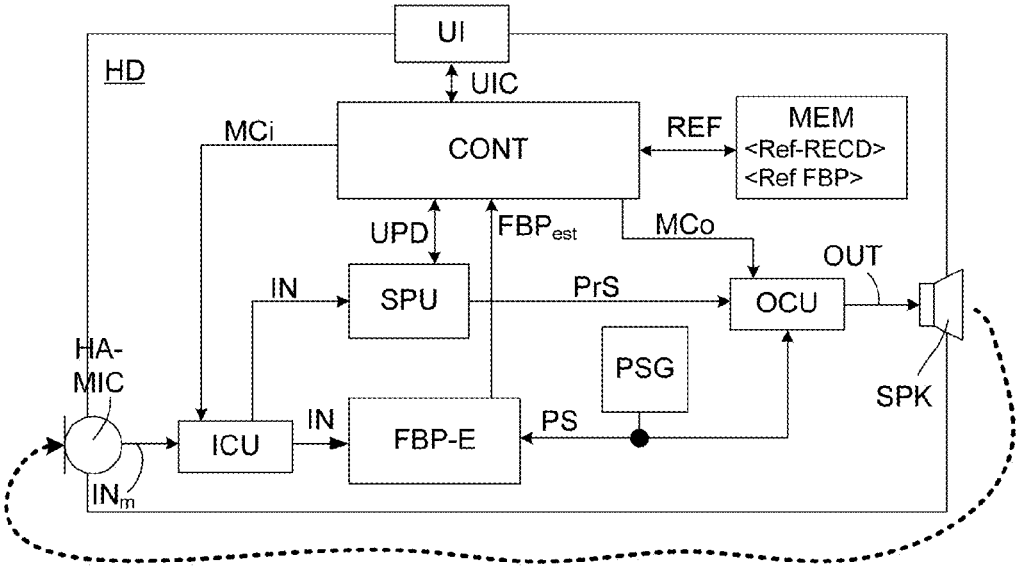

FIGS. 4A-4B show two embodiments of a hearing device according to the present disclosure, FIG. 4A illustrating an embodiment comprising an in-ear microphone for making a real ear measurement, FIG. 4B illustrating an embodiment configured to estimate RECD from a feedback measurement. The embodiments of FIGS. 4A-4B comprise the same functional elements as shown in FIG. 1. In the embodiments of FIGS. 4A-4B, the hearing devices consist of an ITE part adapted for being located in the ear canal (Ear canal) of a user. The ear canal has an opening towards the environment (Environment) and is limited by tissue (Tissue) and the ear drum (Ear drum). The environment input transducer (IT) in FIG. 1 is embodied in microphone (HA-MIC) for converting a sound from the environment (Environment) to an electric input signal $IN_m$. The output transducer (OT) in FIG. 1 is embodied in loudspeaker (SPK) for converting an electric output signal to an output sound, played into the residual volume ($RES_{vol}$) between the ear drum (Ear drum) and the hearing device (HD) when located in the ear canal (Ear canal) of a user. The signal processing unit (SPU), feedback path estimation unit (FBP-E), memory (MEM), control unit (CONT) and probe signal generator (PSG) have the same name and function as in the embodiment of FIG. 1. The input and output SUM units ('+') in FIG. 1 are in FIGS. 4A-4B generalized to input and output combination units (ICU and OCU, respectively). The input and output combination units (ICU and OCU) may implement the functions of a selector or mixer (e.g. summation or multiplication) controllable via control signals MCi and MCo from control unit (CONT). The input combination unit (ICU) may e.g. in a normal mode of operation couple the input signal $IN_m$ (IN) to the signal processing unit. Likewise, the output combination unit (OCU) may e.g. in a normal mode of operation couple the processed signal PrS from the signal processing unit (SPU) to the speaker unit (SPK). In a specific measurement mode, where a current feedback path is estimated, the output combination unit (OCU) is configured to couple the probes signal PS from the probe signal generator (PSG), e.g. a tone generator, to the speaker unit (SPK), and the input combination unit (ICU) is configured to couple the electric input signal $IN_m$ (IN) to the feedback path estimation unit (FBP-E). In this mode of operation, the hearing device operates in an open loop configuration where the leaked part of the probe signal output from the speaker (SPK) is picked up by the microphone (HA-MIC) and fed to the feedback path estimation unit (FBP-E), where an estimate of the current feedback path (signal $FBP_{est}$) is provided (by comparison with the probe signal PS) and delivered to the control unit for comparison with a reference value of the feedback path (stored in the memory (MEM), cf. signal REF). The hearing devices of FIGS. 4A-4B further comprises a user interface (UI), allowing a user to interact with the hearing device and/or allowing the transfer of information to a user. In an embodiment, the hearing device is configured to indicate whether the ITE part is correctly mounted via the user interface.

In the embodiment of FIG. 4A, the hearing device (HD) comprises an ear canal microphone (IN-ear MIC) facing the ear drum when the hearing device is operationally mounted in the ear canal of the user. The ear canal microphone (IN-ear MIC) is configured to pick up a signal representative of a sound pressure level in the residual volume and convert it to an electric signal, which is fed to the control unit (CONT). By comparison with the output level of the probe signal PS (in the measurement mode), and a reference value of RECD store din the memory (MEM), an estimate of a change of RECD (ΔRECD) compared to the stored reference value can be determined. Based on the RECD change an update of prescribed gains can be determined (from a fitting algorithm) and fed to the signal processing unit for use instead of the currently used prescribed gains, cf. signal UPD. The embodiment of FIG. 4A is thus configured to make a simultaneous measurement of current feedback path and RECD. In this case the value of current feedback path can be used to justify (correct/complement) the value of current RECD.

In the embodiment of FIG. 4B, the hearing device (HD), no simultaneous measurement of feedback path and RECD is performed. Only an estimate of the current feedback path is made, and the change in RECD compared to a reference value of RECD<Ref-RECD> stored in memory (MEM) is determined by the control unit from a deviation of the current feedback path FBP from a reference value <Ref-FBP> stored in memory (MEM), cf. e.g. FIGS. 7A-7B and corresponding description.

FIGS. 5A-5B show a hearing system according to an embodiment of the present disclosure, FIG. 5A showing a user (U) wearing a hearing device (HD) in communication with an auxiliary device (AD), FIG. 5B showing the auxiliary device (AD) running an APP for controlling the hearing device (HD), including the initiation of an RECD estimation.

FIG. 5A illustrates the wireless communication link (LINK) established between the hearing device (HD) and the auxiliary device (AD) by antenna and transceiver units (Rx/Tx) in the respective devices.

FIG. 5B illustrates a screen of an APP running on the auxiliary device (AD) for controlling a measurement mode of the hearing device (HD). The APP may constitute a user interface (UI) of the hearing system. The top part of the screen in the box with rounded corners comprises instructions to the user for initiating the measurement mode. The instructions relate to Check that background noise level (NL) is sufficiently low If NL=☺, press START to initiate feedback path estimation ($FBP_{est}$) and RECD estimation ($RECD_{est}$)

If $FBP_{est}$, $RECD_{est}$=☺, press ACCEPT

Otherwise, adjust HA and repeat procedure

The bottom part of the screen contain indicators of Noise level, FBP-RECD est., and Mounting, and activation 'buttons' to START the measurements and to ACCEPT the resulting RECD-estimate (and possibly update prescribed gain values).

In an embodiment, the auxiliary device (AD) comprises a memory wherein reference values of the feedback path and RECD are stored. The reference values may be read from the hearing device (HD), when needed.

Measurement of Reference Values During Fitting of a Hearing Device to a User:

Prior to operation of the hearing device, reference values of the frequency dependent acoustic feedback path from the output transducer to the environment input transducer, or a parameter derived therefrom, when the ITE-part is correctly mounted, and of the frequency dependent real ear to coupler difference, or a parameter derived therefrom, when the ITE-part is correctly mounted, are determined, e.g. in a fitting session.

According to the present disclosure, an estimate of real ear to coupler difference can be determined from an acoustic feedback path measurement.

In order to save time, an RECD from one ear may be copied to another ear, unless it is suspected that the RECD on the other ear may be different.

In an embodiment, simultaneous (or sequential) reference measurements of RECD and acoustic feedback path is performed at a first ear of a user and a reference measurement of acoustic feedback path is performed at the second ear. Based thereon, RECD can be estimated at the second ear of the user (assuming that the ear canal and fitting of the ITE-part of the hearing device are substantially equal at the two ears of the user (symmetry)). This has the advantage of saving time during fitting.

A number of methods for determining the acoustic feedback path and the real ear to coupler difference are available. Regarding the acoustic feedback path, cf. e.g. EP2613566A1 and US20130294610A1. Regarding RECD measurements, cf. e.g. US20060045282A1. An alternative method of measuring RECD is illustrated in FIGS. 6A-6B and described in the following.

Figure 6A:
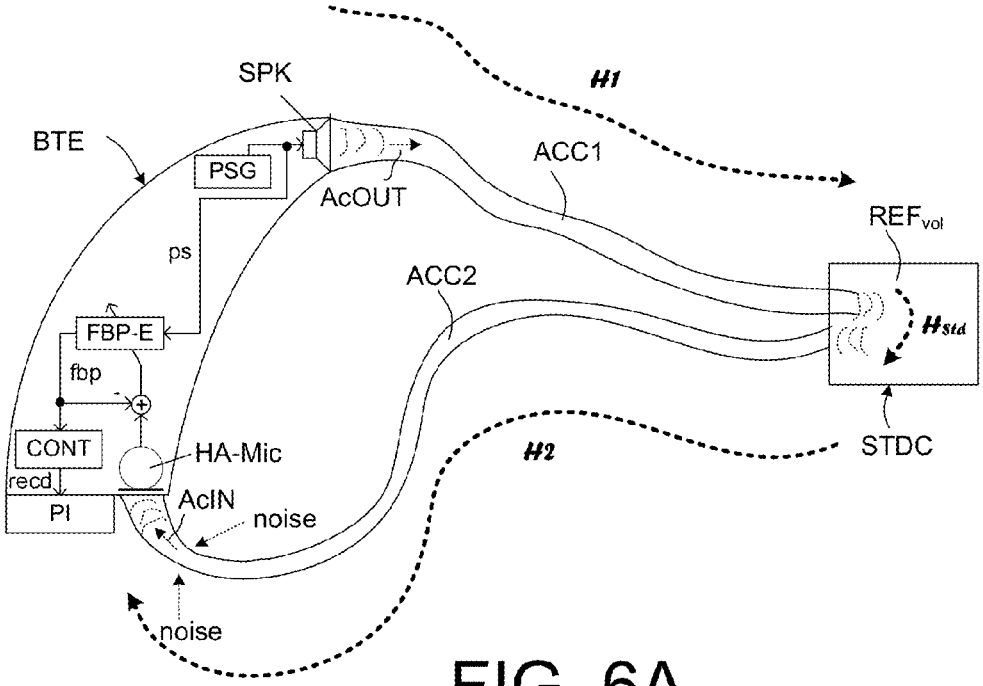
Figure 6B:
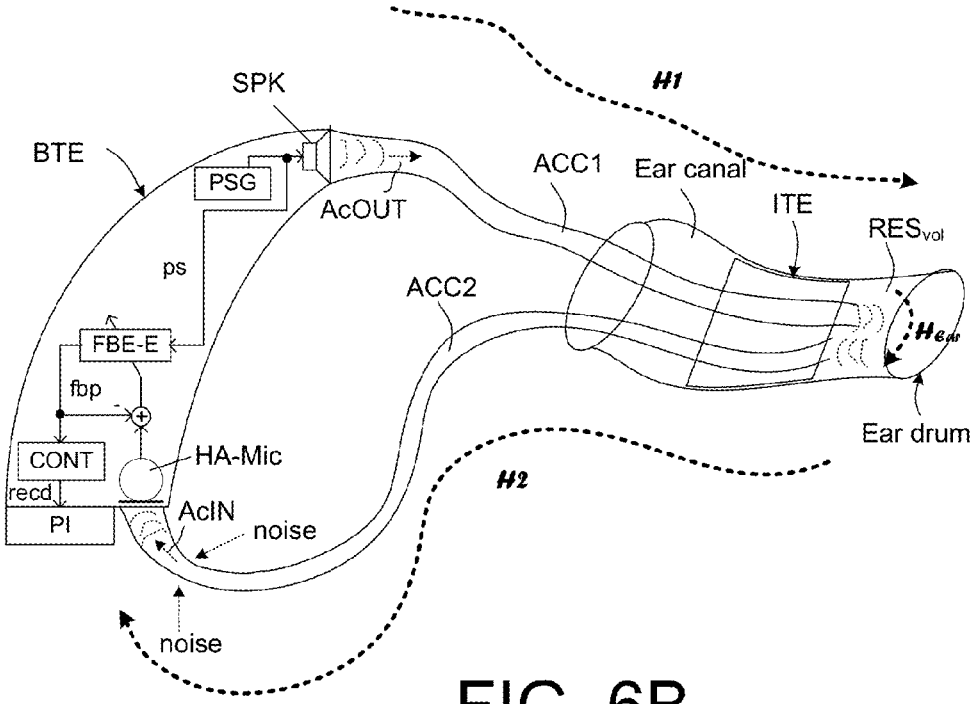

FIGS. 6A-6B show configurations of the hearing assistance device during an exemplary determination of a real ear to coupler difference, FIG. 6A showing the coupler measurement, and FIG. 6B showing the real ear measurement.

FIGS. 6A-6B schematically show configurations of the hearing assistance device (HD) during determination of a real ear to coupler difference. The hearing assistance device comprising a BTE-part (BTE) and an ITE-part (ITE) as described in connection with FIG. 2. The BTE-part comprises the output transducer and the environment input transducer. The acoustic output (providing signal AcOUT) of the output transducer is acoustically coupled to a first acoustic propagation element (ACC1) having a first acoustic transfer function M. The acoustic input (picking up signal Ac/N) of the measurement input transducer is acoustically coupled to a second acoustic propagation element (ACC2) having a second acoustic transfer function H2. Ambient noise from the environment (forming part of (mixed with) the acoustic input signal (AcIN) is indicated by arrows denoted noise. In an embodiment, the first and/or second acoustic propagation element(s) comprise(s) a tube, at least over a part of its longitudinal extension. Preferably, the hearing assistance device and/or the acoustic propagation elements is/are adapted to provide that the acoustic propagation elements are coupled as tightly as possible (i.e. acoustically sealed) to input and/or output transducers of the hearing assistance device and/or the standard coupler.

FIG. 6A shows the coupler measurement, where the first controlled acoustic feedback path from the output transducer to the measurement input transducer via a standard acoustic coupler (STDC) via first and second acoustic propagation elements (ACC1, ACC2). The transfer function from the input to the output of the reference volume $REF_{vol}$ (e.g. a 2-cc coupler) is denoted $H_{std}$. The transfer function from the output transducer to the measurement input transducer, i.e. the transfer function for the acoustic feedback path $F_{est,1}(f)$, can thus (in a logarithmic expression) be expressed as:

$$F_{est,1}(f)=H1(f)+H_{std}(f)+H2(f).$$

While so coupled, the probe signal generator (PSG) generates a first probe signal (cf. e.g. FIGS. 3A-3B), which is played into the first acoustic propagation element (ACC1) and propagated through the coupler and the second the feedback acoustic propagation element (ACC2), picked up by the measurement microphone. An estimate of the first controlled acoustic feedback path $F_{est,1}(f)$ is provided by the feedback estimation unit (FBE) and stored in a memory of the hearing assistance device (e.g. in the processing unit PU) and/or transferred to another device via the communication interface (PI).

Similarly, FIG. 6B shows the real ear measurement, where the first controlled acoustic feedback path from the output transducer to the measurement input transducer via the ear canal (EarCan) and the residual volume between the ITE-part ($HAD_{ITE}$) of the hearing aid device and the user's eardrum (ED) via the first and second acoustic propagation elements (ACC1, ACC2). The transfer function from the input to the output of the residual volume $RES_{vol}$ of the ear is denoted $H_{Ear}$. The transfer function from the output transducer to the measurement input transducer, i.e. the transfer function for the acoustic feedback path $F_{est,2}(f)$, can thus be expressed as:

$$F_{est,}2(f)=H1(f)+H_{Ear}(f)+H2(f).$$

While so coupled, the measurement procedure as described for the coupler measurement is repeated. An estimate of the second controlled acoustic feedback path $F_{est,2}(f)$ is thus provided by the feedback estimation unit (FBE) and stored in a memory of the hearing assistance device (e.g. in the processing unit PU) and/or transferred to another device via the communication interface (PI).

The real ear to coupler difference $RECD(f)=H_{ear}(f)-H_{std}(f)$ is thus determined as $F_{est,2}(f)-F_{est,1}(f)$, because the transfer functions of the acoustic propagation elements (ACC1, ACC2) (assumed identical in the two measurements) cancel out (to a first approximation). Thereby a frequency dependent reference estimate of real ear to coupler difference can be determined.

Figure 7A:
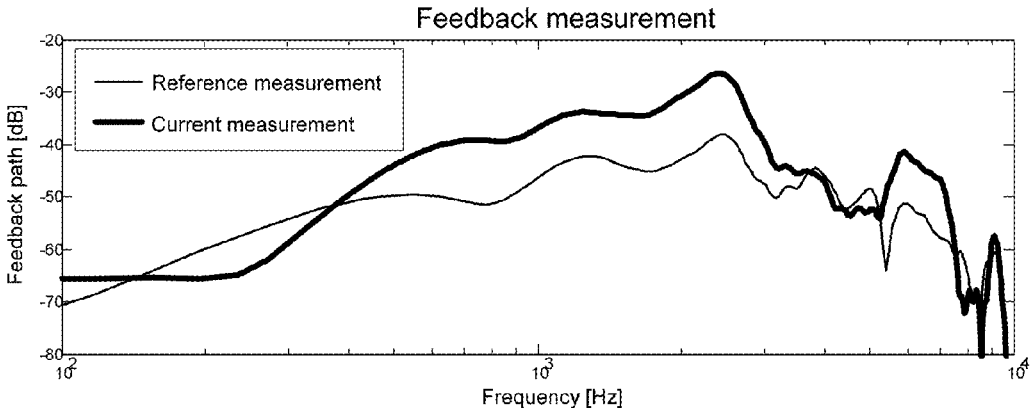
FIGS. 7A-7B show exemplary feedback measurements (FIG. 7A) and RECD measurements (FIG. 7B).
Figure 7B:
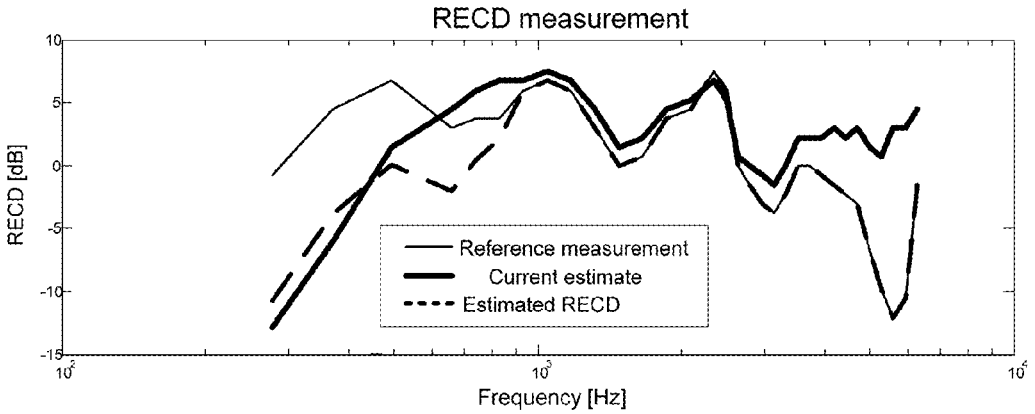

FIGS. 7A-7B show exemplary feedback measurements (FIG. 7A) and RECD measurements (FIG. 7B) in dB versus frequency between 100 Hz and 10 kHz (logarithmic scale). FIG. 7A shows a reference measurement (thin solid line) and a current measurement (bold solid line) of feedback path from an output transducer to an input transducer of a hearing device according to the present disclosure. FIG. 7B shows a reference measurement of RECD (thin solid line) and a current estimate of RECD (bold solid line) and the difference ΔRECD (dashed bold line) between the reference and the current (estimated) RECD based on difference between the reference and current feedback paths of FIG. 7A.

The change in RECD may e.g. be estimated by the following equation:

$$\Delta RECD(f) = u(f)\sum_{f'=0}^{f'_{max}} w(f, f')\Delta FBP(f')$$

where ΔRECD(f) is the estimated change in RECD for a given frequency f, ΔFBP is the difference between the reference feedback path and the estimated current feedback path (as measured), f' denotes frequencies belonging to a frequency interval within the range $[f_{min}; f'_{max}]$, w(f,f') is a weighting function. I.e. we estimate a change in RECD by estimating a frequency weighted average change of the feedback path. The weighting function w may e.g. only weight frequencies in a selected frequency range, e.g. between 1000 Hz and 3000 Hz (e.g. w=1, for 1 kHz<f'<3 kHz, and w=0 for all other values of f' between 0 and $f_{max}$). The weighting function w may depend on frequency f in a linear or non-linear way. u(f) is another weighting function (e.g. u=−1 for f<1 kHz and u=0, for f>1 kHz). Both u(f) and w(f,f') can be estimated using training data (prerecorded sets of RECD and feedback path measurements). The reference RECD is thus modified by adding ΔRECD to the reference RECD. The ΔRECD may as well be saturated in order not to exceed a certain range (i.e. a limit is imposed on the allowed effect of ΔRECD).

The present disclosure proposes:

Simultaneous measurement of the RECD and the feedback path is performed at a number of frequencies (in a fitting session and/or during normal use)

Measurements (reference or current) may be performed using tones, part of the proposal is to play the tones so that the user feels as little discomfort as possible. This could be achieved by playing the tones in the manner of a "start-up jingle". I.e. whenever the start-up jingle is played, it will be possible to carry through a measurement [RECD as well as feedback-path]. Alternatively, reference RECD values may be based on a model of the development of RECD, e.g. related to time, e.g. a change in time, e.g. to a current age or an estimate of a current age.

Calculating the amplification (prescribed gains versus frequency) based on both the RECD (e.g. reference RECD) and the feedback path measurements (e.g. current and reference FBP measurements).

Adjusting the amplification (prescribed gain) at relatively low frequencies (e.g. below 1 kHz-2 kHz) based on a feedback path measurement (e.g. at a few frequencies). The feedback path measurement may be performed when the ear-mould is mounted after the hearing aid is turned on.

The feedback path measurement algorithm used in the hearing aid during normal operation may be (re-)used to do the FBP measurements in the measurement mode.

If the hearing aid has more than one microphone, it may only be necessary to measure the simultaneous feedback path at one of microphones The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof.

REFERENCES

[Haykin] S. Haykin, Adaptive filter theory (Fourth Edition), Prentice Hall, 2001.

EP2613566A1 (OTICON)

US20130294610A1 (OTICON)

US20060045282A1 (BERNAFON).

The invention claimed is:

1. A hearing device comprising:

an in-the-ear (ITE) part, adapted for being located at or in an ear canal of a user;

an environment input transducer for converting an input sound signal to an electric input signal;

an output transducer for converting an electric output signal to an output sound;

a forward path comprising a configurable signal processing unit, which, at least in a specific normal mode of operation, is operationally coupled to the environment input transducer and to the output transducer, and adapted to process an input signal according to a set of processing parameters and to provide a processed output signal;

a feedback estimation unit for providing a current estimate of an acoustic feedback path from the output transducer to the environment input transducer;

access to a memory for storing a frequency dependent reference estimate of the acoustic feedback path from the output transducer to the environment input transducer, or a parameter derived therefrom, when the ITE-part is correctly mounted, and a frequency dependent reference estimate of real ear to coupler difference, or a parameter derived therefrom, when the ITE-part is correctly mounted, wherein the hearing device is configured, in a specific measurement mode, to perform a feedback measurement, and to provide a frequency dependent current estimate of the acoustic feedback path based on said probe signal, wherein the hearing device further comprises:

a control unit operatively connected to said memory, and configured to compare said current estimate of the acoustic feedback path based on said probe signal with said reference estimate of the acoustic feedback path, and to provide a current feedback path difference measure, and to determine a current estimate of real ear to coupler difference from current feedback path difference measure; and a probe signal generator for generating a probe signal, and, in said specific measurement mode, the hearing device being configured to perform a feedback measurement by the feedback estimation unit by feeding the probe signal to the output transducer and receiving a resulting feedback signal by the environment transducer, wherein the control unit is configured to bring the hearing device in said specific measurement mode and to initiate a feedback measurement by the feedback estimation unit according to a predefined scheme.

2. A hearing device according to claim 1 wherein the control unit is configured to determine updated processing parameters based on said current estimate of real ear to coupler difference.

3. A hearing device according to claim 1 wherein the control unit is configured to transfer said updated processing parameters to said configurable signal processing unit for use instead of previous processing parameters.

4. A hearing device according to claim 1 wherein the control unit is configured to determine a current estimate of real ear to coupler difference in a frequency range below a predetermined threshold frequency $f_{th}$ from the current feedback path difference measure above said threshold frequency $f_{th}$.

5. A hearing device according to claim 1 comprising a user interface allowing to transfer information to a user and/or a user to interact with the hearing device.

6. A hearing device according to claim 5 configured to indicate via said user interface whether the ITE part is correctly mounted.

7. A hearing device according to claim 1 wherein the ITE-part comprises said environment input transducer.

8. A hearing device according to claim 1 wherein the probe signal comprises a number of tones.

9. A hearing device according to claim 1 wherein the control unit is operatively connected to the probe signal generator and/or to the feedback estimation unit.

10. A hearing device according to claim 1 wherein the predefined scheme comprises that the specific measurement mode is entered in connection with a power-up of the hearing device.

11. A hearing device according to claim 1 comprising a hearing aid for compensating a user's hearing impairment.

12. A hearing system comprising a hearing device according to claim 1 and an auxiliary device, wherein the hearing device and the auxiliary device comprises antenna and transceiver circuitry for establishing a communication link between them and allowing an exchange of data between them.

13. A method of operating a hearing device, the hearing device comprising:

an in-the-ear (ITE) part, adapted for being located at or in an ear canal of a user;

an environment input transducer for converting an input sound signal to an electric input signal;

an output transducer for converting an electric output signal to an output sound;

a forward path comprising a configurable signal processing unit, which, at least in a specific normal mode of operation, is operationally coupled to the environment input transducer and to the output transducer, and adapted to process an input signal according to a set of processing parameters and to provide a processed output signal;

a feedback estimation unit for providing a current estimate of an acoustic feedback path from the output transducer to the environment input transducer, the method comprising:

storing a frequency dependent reference estimate of the acoustic feedback path from the output transducer to the environment input transducer, or a parameter derived therefrom, when the ITE-part is correctly mounted;

storing a frequency dependent reference estimate of real ear to coupler difference, or a parameter derived therefrom, when the ITE-part is correctly mounted;

in a specific measurement mode initiating a feedback measurement by the feedback estimation unit based on a signal received by said environment transducer;

providing a frequency dependent current estimate of the acoustic feedback path;

comparing said current estimate of the acoustic feedback path with said reference estimate of the acoustic feedback path and providing a current feedback path difference measure;

determining a current estimate of real ear to coupler difference from current feedback path difference measure; and bringing the hearing device in said specific measurement mode and to initiate a feedback measurement by the feedback estimation unit according to a predefined scheme.

14. A method according to claim 13 comprising:

in the specific measurement mode, generating a probe signal;

performing a feedback measurement by the feedback estimation unit by feeding the probe signal to the output transducer and receiving a resulting feedback signal by the environment transducer;

providing a frequency dependent current estimate of the acoustic feedback path based on the probe signal.

15. A method according to claim 13 comprising:

determining updated processing parameters based on said current estimate of real ear to coupler difference; and transferring said updated processing parameters to said configurable signal processing unit for use instead of previous processing parameters.

16. A method according to claim 13 comprising providing that the predefined scheme comprises that the specific measurement mode is entered in connection with a power-up of the hearing device.

17. A data processing system comprising a processor and program code means for causing the processor to perform the steps of the method of claim 13.

* * * * *